US009677560B1

(12) United States Patent
Davis et al.

(10) Patent No.: US 9,677,560 B1
(45) Date of Patent: Jun. 13, 2017

(54) CENTRIFUGAL PUMP IMPELLER SUPPORT SYSTEM AND APPARATUS

(71) Applicant: Summit ESP, LLC, Tulsa, OK (US)

(72) Inventors: Gregory Austin Davis, Broken Arrow, OK (US); Freddie George Walton, Midland, TX (US); Wesley John Nowitzki, Broken Arrow, OK (US)

(73) Assignee: Summit ESP, LLC, Tulsa, OK (US)

( * ) Notice: Subject to any disclaimer, the term of this patent is extended or adjusted under 35 U.S.C. 154(b) by 0 days.

(21) Appl. No.: 14/796,610

(22) Filed: Jul. 10, 2015

Related U.S. Application Data

(60) Provisional application No. 62/023,550, filed on Jul. 11, 2014.

(51) Int. Cl.
*F04D 29/08* (2006.01)
*F04D 1/08* (2006.01)
(Continued)

(52) U.S. Cl.
CPC ..... *F04D 1/08* (2013.01); *F04D 13/086* (2013.01); *F04D 13/10* (2013.01); *F04D 17/12* (2013.01);
(Continued)

(58) Field of Classification Search
CPC ..... F04D 1/08; F04D 13/10; F04D 29/4293; F04D 29/605; F04D 17/12; F04D 13/086;
(Continued)

(56) References Cited

U.S. PATENT DOCUMENTS 1,448,925 A * 3/1923 Fulton ..... F04D 29/043 403/356
1,642,914 A 9/1927 Whann
(Continued)

FOREIGN PATENT DOCUMENTS

CN 102606490 A 7/2012

OTHER PUBLICATIONS

Centrifugal Pumps for Petroleum, Petrochemical and Natural Gas Industries, ANSI/API Standard 610, 11th Edition, American Petroleum Institute, Sep. 2010.*
(Continued)

*Primary Examiner* — Richard Edgar
(74) *Attorney, Agent, or Firm* — Frederic Dorwart, Lawyers PLLC; Penina Michlin Chiu

(57) ABSTRACT

A centrifugal pump impeller support system and apparatus is described. A centrifugal pump includes an impeller including an impeller eye skirt extending axially from an eye of the impeller, and in certain stages, a balance ring skirt, and an impeller support insert secured around an outer diameter of at least one of the impeller skirts, each of the at least one impeller support inserts including a sleeve extending tubularly around the impeller skirt, and a flange extending perpendicularly to a longitudinal axis of the centrifugal pump shaft. A diffuser stacked adjacent to the impeller includes a bushing secured around an inner diameter of the diffuser flow exit outward of the impeller eye skirt support insert or a bushing secured around an inner diameter of the flow entrance outward of the balance ring skirt support insert.

19 Claims, 11 Drawing Sheets

(51) Int. Cl.

| | |
|---|---|
| ***F04D 13/08*** | (2006.01) |
| ***F04D 13/10*** | (2006.01) |
| ***F04D 17/12*** | (2006.01) |
| ***F04D 25/06*** | (2006.01) |
| ***F04D 29/42*** | (2006.01) |
| ***F04D 29/44*** | (2006.01) |
| ***F04D 29/60*** | (2006.01) |

(52) U.S. Cl.
CPC ..... *F04D 25/0686* (2013.01); *F04D 29/4273* (2013.01); *F04D 29/4293* (2013.01); *F04D 29/448* (2013.01); *F04D 29/605* (2013.01)

(58) Field of Classification Search
CPC ..... F04D 25/0686; F04D 29/4273; F04D 29/448; F04D 13/08; F04D 29/16; F04D 29/168; F04D 17/122; F04D 29/2266; F04D 29/041; F04D 29/0413; F04D 29/046; F04D 29/047; F04D 29/0473; F04D 29/10; F04D 29/106; F04D 29/12; F04D 29/126
See application file for complete search history.

(56) References Cited

U.S. PATENT DOCUMENTS 2,066,505 A 1/1937 Wolfe
2,271,336 A 1/1942 Goldsmith
3,215,083 A 11/1965 Sarles et al.
3,265,001 A * 8/1966 Deters ..... F04D 13/10 415/141
3,404,924 A 10/1968 Choate
4,678,399 A * 7/1987 Vandevier ..... F04D 29/167 415/104
4,781,531 A 11/1988 James
4,838,758 A * 6/1989 Sheth ..... F04D 13/10 415/140
5,184,945 A 2/1993 Chi-Wei
5,667,314 A 9/1997 Limanowka et al.
5,722,812 A * 3/1998 Knox ..... F04D 1/06 415/199.1
5,765,950 A 6/1998 Eno et al.
6,017,184 A 1/2000 Aguilar et al.
6,068,444 A * 5/2000 Sheth ..... F04D 1/06 415/104
6,106,224 A * 8/2000 Sheth ..... F04D 29/0413 415/104
6,309,174 B1 10/2001 Oklejas, Jr. et al.
7,530,391 B2 5/2009 Hall et al.
7,575,413 B2 * 8/2009 Semple ..... F04D 1/063 384/275
7,670,056 B2 3/2010 Petitjean et al.
7,909,090 B2 3/2011 Reid
8,066,476 B2 * 11/2011 Orban ..... F04D 13/10 415/196
8,287,235 B2 10/2012 Orban et al.
8,337,142 B2 * 12/2012 Eslinger ..... F04D 29/0413 415/1
8,400,035 B2 3/2013 Watson
8,491,277 B2 7/2013 Kawabata et al.
8,568,081 B2 * 10/2013 Song ..... F04D 29/041 415/1
8,651,836 B2 2/2014 Parmeter et al.
8,684,679 B2 4/2014 Tetzlaff et al.
8,801,360 B2 * 8/2014 Sheth ..... E21B 43/128 415/1
2004/0057642 A1 3/2004 New
2012/0020777 A1 1/2012 Eslinger
2013/0017075 A1 1/2013 Orban et al.
2013/0209225 A1 * 8/2013 Eslinger ..... F04D 7/04 415/104
2014/0030055 A1 1/2014 Jayaram et al.
2015/0023815 A1 1/2015 Tetzlaff et al.

OTHER PUBLICATIONS

Electrical Submersible Pumps Manual: Design, Operations, and Maintenace, Gabor Takacs, Ph.D, Elsevier Inc., 2009.*

* cited by examiner

CENTRIFUGAL PUMP IMPELLER SUPPORT SYSTEM AND APPARATUS

CROSS REFERENCE TO RELATED APPLICATIONS

This application claims the benefit of U.S. Provisional Application No. 62/023,550 to Davis et al., filed Jul. 11, 2014 and entitled "DOWNTHRUST AND RADIAL SKIRT SUPPORT INSERT FOR CENTRIFUGAL PUMP STAGES," which is hereby incorporated by reference in its entirety.

BACKGROUND OF THE INVENTION

1. Field of the Invention

Embodiments of the invention described herein pertain to the field of multi-stage centrifugal pumps. More particularly, but not by way of limitation, one or more embodiments of the invention enable a centrifugal pump impeller support system and apparatus.

2. Description of the Related Art

Fluid, such as gas, oil or water, is often located in underground formations. In such situations, the fluid must be pumped to the surface so that it can be collected, separated, refined, distributed and/or sold. Centrifugal pumps are typically used in electric submersible pump applications for lifting well fluid to the surface. Centrifugal pumps impart energy to a fluid by accelerating the fluid through a rotating impeller paired with a stationary diffuser. A rotating shaft runs through the central hub of the impeller and diffuser. A motor upstream of the pump turns the shaft of the pump motor, and the impeller is keyed to the shaft, causing the impeller to rotate with the shaft.

Each rotating impeller and stationary diffuser pair is called a "stage". The impeller's rotation confers angular momentum to the fluid passing through the pump. The changes in angular momentum convert kinetic energy into pressure, thereby raising the pressure on the fluid and lifting it to the surface. Multiple stages of impeller and diffuser pairs may be used to further increase the pressure lift. The stages are stacked in series around the pump's shaft, with each successive impeller sitting on a diffuser of the previous stage.

In both radial and mixed flow stages, one method of handling the axial thrust of the pump is to allow each impeller to move axially along the pump shaft between the diffusers. In such instances, the impeller is keyed to the shaft within a key groove that runs axially along the length of the shaft. When the impellers can move independently of the shaft, the pump is referred to as a "floater style" pump. When the impellers are not able to move independently of the shaft, the pump is referred to as a "compression style" pump.

Impellers typically have a "skirt" extending axially on the bottom side of the impeller. A downthrust washer extends radially along the bottom side of the impeller, adjacent to the bottom skirt. The bottom impeller skirt outer diameter (OD) rotates inside the diffuser exit inner diameter (ID). Typically, the diffuser exit includes a downthrust pad that is opposite the downthrust washer. FIG. 1A illustrates a conventional impeller and diffuser pair of the prior art. The close tolerance between conventional skirt OD 100 and conventional diffuser exit ID 105 provides a hydraulic seal when fluid is pumped. The hydraulic seal helps to maintain the lift produced from stage to stage. Conventional downthrust pad 115 traditionally carries the downthrust load of the pump, which conventional downthrust pad is in close tolerance with conventional washer 120. Conventional washer 120 is typically made of a phenolic resin material.

As the skirt wears, for example from abrasives such as sand, dirt, rock and other solid particles in the pumped fluid, the conventional gap 110 shown in FIG. 1B, between the conventional impeller skirt OD 100 and conventional diffuser exit ID 105 increases. As conventional gap 110 increases, more fluid and pressure leaks, and the pump performance is reduced. The conventional gap 110 (tolerance) between the impeller skirt OD 100 and diffuser exit ID 105 should be between about 0.012 inches and 0.016 inches diametrically (0.006-0.008 inches radially). Conventional gaps 110 in excess of about 0.016 inches diametrically cause reduced pump production, which may necessitate that the pump be pulled out of operation. Similarly, as conventional washer 120 breaks down due to abrasives in the pumped fluid, downthrust pad 115 becomes less effective in handling downthrust loads during pump operation. A similar tolerance and/or hydraulic seal on the top of the impeller is similarly susceptible to erosion from abrasives.

Conventionally, a hard coating such as tungsten carbide, has been applied to impeller skirts in order to prevent wear from abrasives in well fluid. However, coating an impeller is time consuming and expensive. Even if the impeller skirt is coated, conventional washer 120 is still susceptible to abrasive wear.

Separately, to extend downthrust protection, conventional centrifugal pumps employ a flanged sleeve, which is keyed to the pump shaft inside a stationary bushing. A conventional flanged sleeve and stationary bushing of the prior art is illustrated in FIG. 2. Conventional flanged sleeve 310 and conventional stationary bushing 300 form a bearing set which provides the pump with protection from downthrust. Conventional stationary bushing 300 is fixed into the conventional hub 315 of conventional diffuser 305. Conventional flanged sleeve 310 is keyed to the shaft of the pump and rotates at the same speed. The problem with conventional flanged sleeves and conventional bushings is that they fail to adequately protect hydraulic seal portions of the impeller from abrasive wear.

In addition to downthrust protection, centrifugal pumps require radial support to keep the shaft centered inside the impeller and diffuser stages. Without radial support the impellers can contact mating diffusers, creating excessive wear and leading to excessive vibration and potentially a pump failure. Conventional pumps rely on the impeller and diffuser hubs to provide radial support, and in some instances, tungsten carbide bearings at the very top and bottom of the pump stages. However, abrasive wear can reduce the radial support provided by the hubs, and in such instances, the top and bottom bearings may be insufficient to provide the required radial support throughout the pump.

As is apparent from the above, current centrifugal pumps support systems suffer from many shortcomings. Therefore, there is a need for a centrifugal pump impeller support system and apparatus.

BRIEF SUMMARY OF THE INVENTION

One or more embodiments of the invention enable a centrifugal pump impeller support system and apparatus.

A centrifugal pump impeller support system and apparatus is described. An illustrative embodiment of a centrifugal pump includes an impeller secured to a centrifugal pump shaft, the impeller including at least one of an impeller eye skirt, a balance ring skirt or both, and an impeller support insert secured around an outer diameter of at least one of the at least one skirts, each of the at least one impeller support inserts including a sleeve extending tubularly around the skirt, and a flange extending perpendicularly to a longitudinal axis of the centrifugal pump shaft. In some embodiments, the at least one skirt is the impeller eye skirt extending axially from a portion defining an eye of the impeller and the centrifugal pump further includes a diffuser stacked adjacent to the impeller, the diffuser including a portion defining a diffuser flow exit, wherein the impeller eye skirt extends within the portion defining the diffuser flow exit, and a bushing secured around an inner diameter of the portion defining the diffuser flow exit outward of the impeller support insert. In certain embodiments, the at least one impeller skirt is a balance ring skirt and the centrifugal pump further includes a diffuser paired with the impeller, the diffuser including a portion defining a diffuser flow entrance, wherein the balance ring skirt extends within the portion defining the diffuser flow entrance, and a bushing secured around an inner diameter of the portion defining the diffuser flow entrance outward of the impeller support insert. In some embodiments, the impeller is in an electric submersible pump assembly.

An illustrative embodiment of a centrifugal pump includes a diffuser fixedly secured within a housing of a centrifugal pump, the diffuser including a portion defining a flow exit, an impeller keyed to a shaft of the centrifugal pump, the impeller including a skirt extending inward of the portion defining the flow exit and axially from a portion of the impeller defining an eye, a sleeve affixedly coupled around an outer diameter of the skirt, and a bushing secured circumferentially about an inner diameter of the portion defining the flow exit outward of the sleeve. In some embodiments, the sleeve includes a flange extending radially from the sleeve on a downstream side of the sleeve. In some embodiments, a surface of the bushing facing the sleeve includes a diagonal axial groove that intersects with a radial groove.

An illustrative embodiment of a centrifugal pump includes a plurality of centrifugal pump stages, wherein each of the plurality of centrifugal pump stages include a rotatable impeller inward of a stationary diffuser, an impeller support insert fixedly attached to a top of the impeller such that the impeller support insert rotates with the impeller, wherein the impeller support insert is fixedly coupled to an impeller balance ring, and a bushing pressed into a portion defining a diffuser flow entrance and extending circumferentially about the impeller support insert such that the bushing and impeller support insert form a hydraulic bearing set. In some embodiments, the impeller support insert is fixedly attached to the impeller by one of pin, bolt, press fit or a combination thereof. In certain embodiments, the impeller support insert is keyed to the impeller, the impeller is keyed to a pump shaft and the impeller support insert moves with respect to the pump shaft during operation of the plurality of centrifugal pump stages.

In further embodiments, features from specific embodiments may be combined with features from other embodiments. For example, features from one embodiment may be combined with features from any of the other embodiments. In further embodiments, additional features may be added to the specific embodiments described herein.

BRIEF DESCRIPTION OF THE DRAWINGS

The above and other aspects, features and advantages of the invention will be more apparent from the following more particular description thereof, presented in conjunction with the following drawings wherein:

FIG. 4 is a cross sectional view of a downthrust side of a diffuser with a bushing of an illustrative embodiment.

Figure 1A:
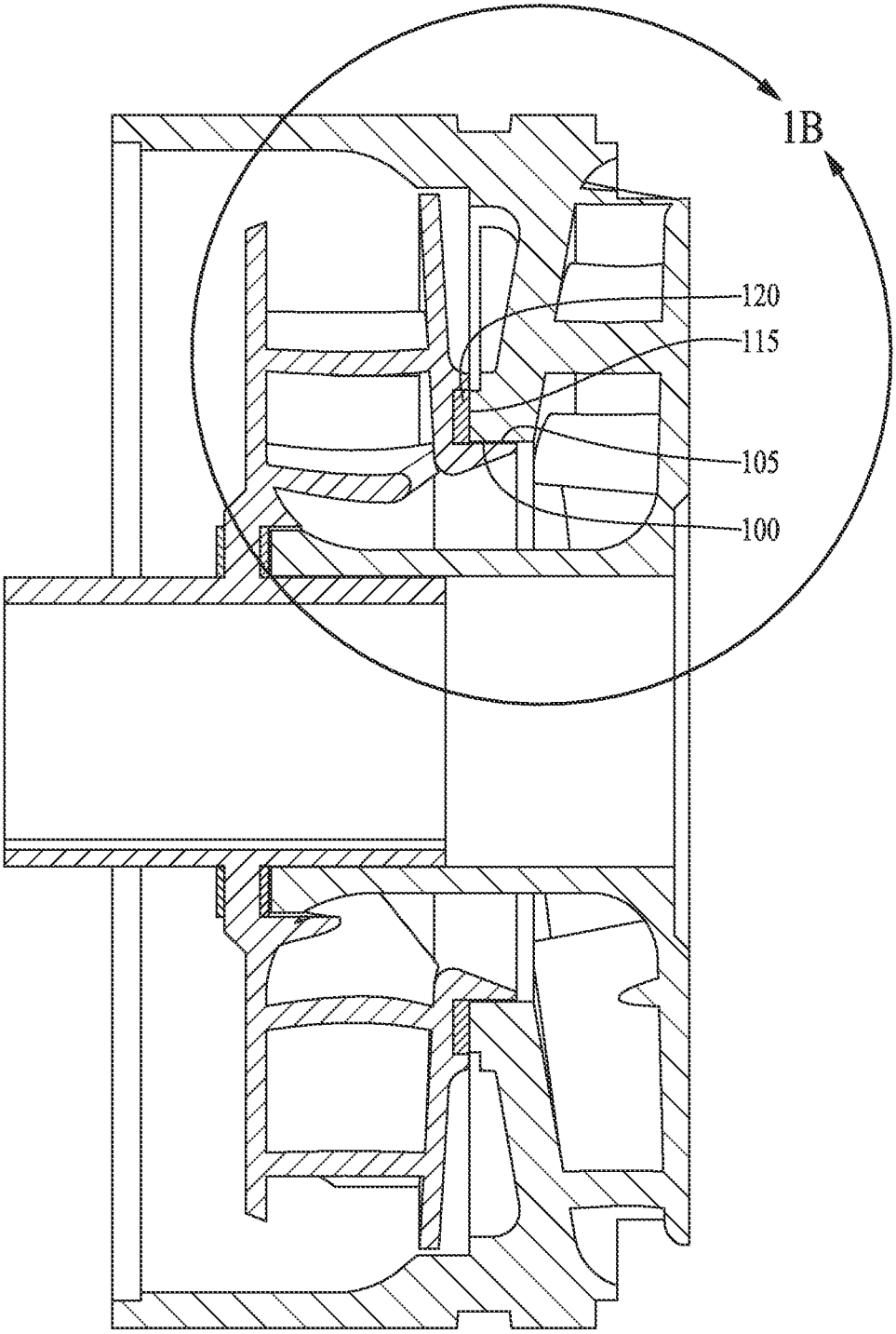
FIG. 1A PRIOR ART
FIG. 1A is a cross-sectional view of a centrifugal pump of the prior art.
Figure 1B:
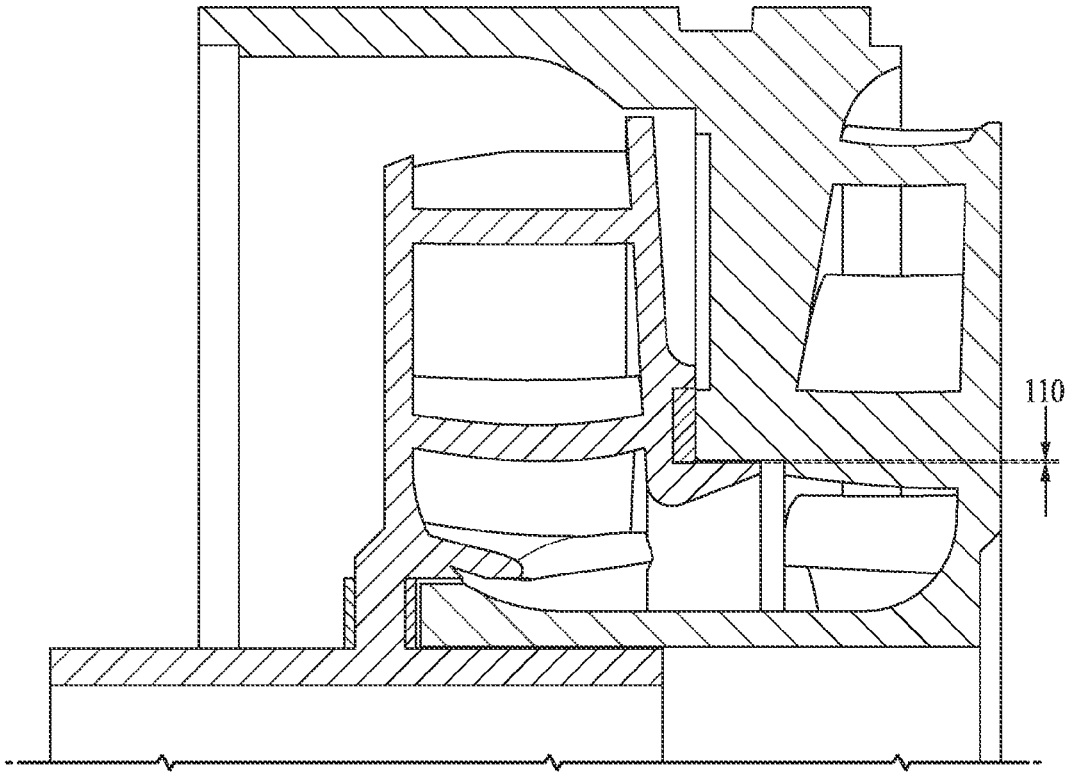
FIG. 1B PRIOR ART
FIG. 1B is an enlarged cross-sectional view of the centrifugal pump of FIG. 1A of the prior art.
Figure 2:
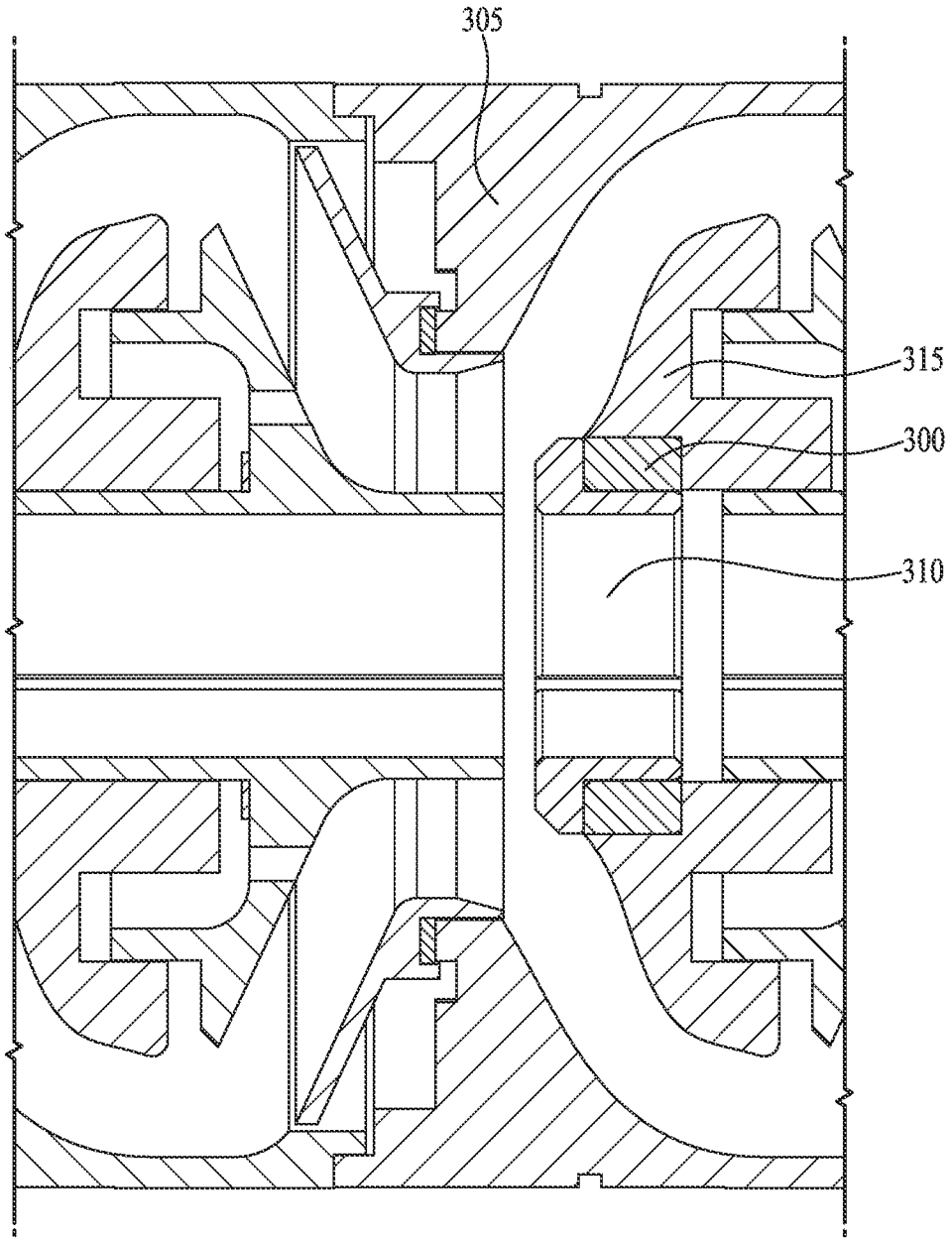
FIG. 2 PRIOR ART
FIG. 2 is a conventional bearing set of a centrifugal pump of the prior art.
Figure 1:
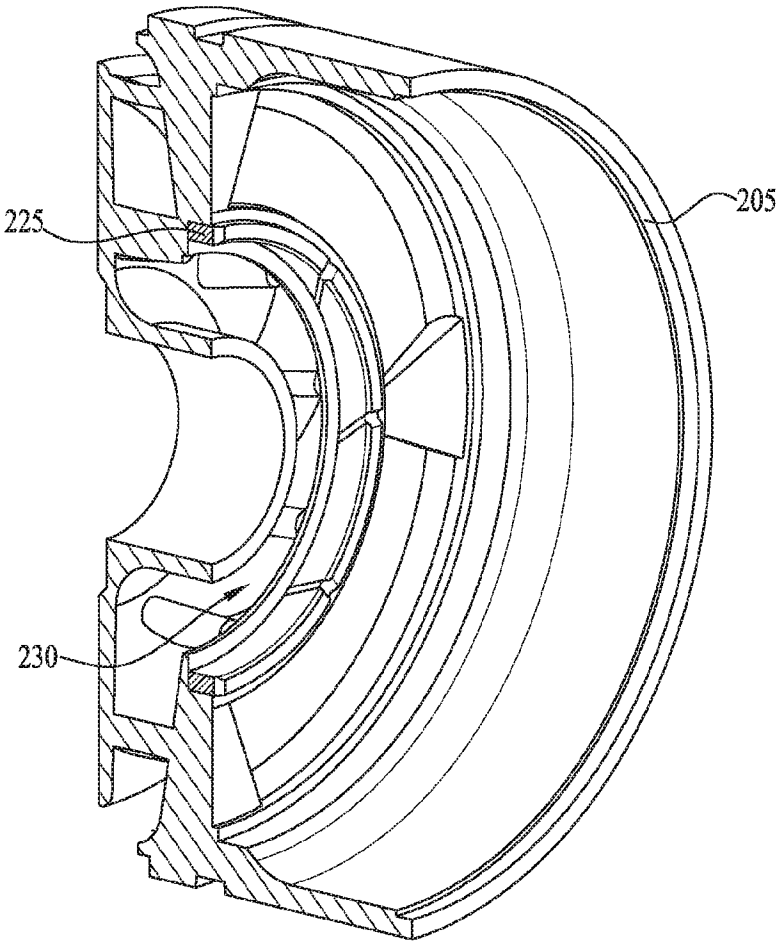

While the invention is susceptible to various modifications and alternative forms, specific embodiments thereof are shown by way of example in the drawings and may herein be described in detail. The drawings may not be to scale. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION

A centrifugal pump impeller support system and apparatus will now be described. In the following exemplary description, numerous specific details are set forth in order to provide a more thorough understanding of embodiments of the invention. It will be apparent, however, to an artisan of ordinary skill that the present invention may be practiced without incorporating all aspects of the specific details described herein. In other instances, specific features, quantities, or measurements well known to those of ordinary skill in the art have not been described in detail so as not to obscure the invention. Readers should note that although examples of the invention are set forth herein, the claims, and the full scope of any equivalents, are what define the metes and bounds of the invention.

As used in this specification and the appended claims, the singular forms “a”, “an” and “the” include plural referents unless the context clearly dictates otherwise. Thus, for example, reference to a stage includes one or more stages.

"Coupled" refers to either a direct connection or an indirect connection (e.g., at least one intervening connection) between one or more objects or components. The phrase "directly attached" means a direct connection between objects or components.

As used herein, the term "outer," "outside" or "outward" means the radial direction away from the center of the shaft of the centrifugal pump and/or the aperture of the pump component through which the shaft would extend.

As used herein, the term "inner", "inside" or "inward" means the radial direction toward the center of the shaft of the centrifugal pump and/or the aperture of the pump component through which the shaft would extend.

As used herein the term "axial" or "axially" refers to the longitudinal direction along the length of the shaft of a centrifugal pump.

Pressure gradients and momentum transferred across an impeller create hydraulic thrust in each stage. "Downthrust" refers to the thrust in an upstream direction, which by way of example, in vertical electric submersible pump (ESP) assemblies is generally the downward direction. In vertical ESP assemblies, for example, downthrust is carried by the bottom of the impeller. "Upthrust" refers to the thrust in a downstream direction, which by way of example, in vertical ESP assemblies is generally the upward direction. In vertical ESP assemblies, for example, upthrust is carried by the top of the impeller. For ease of illustration and so as not to obscure the invention, the side of the impeller that carries downthrust is referred to herein as the "bottom" of the impeller, and the side of the impeller that carries upthrust is referred to herein as the "top" of the impeller, as is the case in vertical ESP assembly applications. However, the invention is not so limited and may be applied equally in horizontal pump embodiments.

As used herein, the term "downstream" means the direction substantially with the flow of working fluid when the centrifugal pump is in operation. "Upstream" means the direction substantially opposite the flow of working fluid when the centrifugal pump is in operation.

One or more embodiments of the invention provide a centrifugal pump impeller support system and apparatus. While the invention is described in terms of a downhole oil and/or gas pumping embodiment, nothing herein is intended to limit the invention to that embodiment.

Illustrative embodiments provide for an impeller support insert that may create a hydraulic seal between an impeller and a diffuser of a centrifugal pump. Illustrative embodiments may provide hydraulic lift, may be resistant to abrasive wear, and may provide both radial and axial support to the impeller. An impeller support insert, which may include a sleeve and/or a sleeve with flange, may be attached around an outer diameter of the impeller eye skirt on the bottom of the impeller and/or the impeller balance ring skirt on the top of the impeller. During operation of the centrifugal pump, the impeller support insert may rotate with the impeller at the same speed as the impeller. In floater style stages, the impeller support insert may also move axially along the pump shaft with the impeller. The impeller support insert may replace or be in addition to a conventional downthrust and/or upthrust washer.

A bushing of illustrative embodiments may be paired with the impeller support insert. With respect to a downthrust bushing, the bushing may be pressed into the inner diameter of the diffuser portion defining the flow exit and face the impeller support insert. With respect to an upthrust bushing, the bushing may be pressed into the inner diameter of the diffuser portion defining the flow entrance and face the impeller support insert. The impeller support insert and bushing of illustrative embodiments may form a bearing set and/or seal that may handle the downthrust load of the pump and/or the upthrust load of the pump, rather than the downthrust pad and/or upthrust pad of the diffuser that would conventionally serve that function. The bearing set of illustrative embodiments may be added to a stage in addition to a conventional thrust bearing set, or may replace a conventional thrust bearing set. In some embodiments, the impeller support insert and bushing of illustrative embodiments may obviate the need for a bearing set keyed to the pump's shaft.

The impeller support insert of illustrative embodiments may serve multiple functions: in floater style pumps it may provide axial support to counteract downthrust loads produced by impellers during operation; in mixed flow stages it may counteract upthrust loads; in both floater and compression style pumps, it may provide radial support to keep the shaft and impellers centered within the diffusers; and in both floater and compression style pumps it also may provide the impeller skirt(s) protection from abrasive wear in pumped fluid. Protection from abrasive wear may assist in maintaining a tight tolerance between the impeller support insert and diffuser bushing to maintain pump production and pressure, without the need for a tungsten carbide coating on the impeller. Illustrative embodiments may improve prior art stages in that a single bearing set serves the function of what was previously two separate pump components: a thrust bearing set having a flanged sleeve keyed to the shaft, and tungsten carbide coating on the impeller skirt, diffuser flow exit and/or diffuser flow entrance. In addition, in illustrative embodiments a washer adjacent to the impeller skirt may no longer be necessary, the diffuser downthrust pad may no longer carry downthrust loads, the diffuser upthrust pad may no longer carry upthrust loads, and/or the impeller and diffuser hubs, which are susceptible to abrasive wear, may no longer be the primary source of radial support to the pump. Illustrative embodiments may improve a centrifugal pump's resistance to abrasion in addition to providing hydraulic lift, radial support, downthrust support, and in some flow stages, upthrust support.

Figure 3:
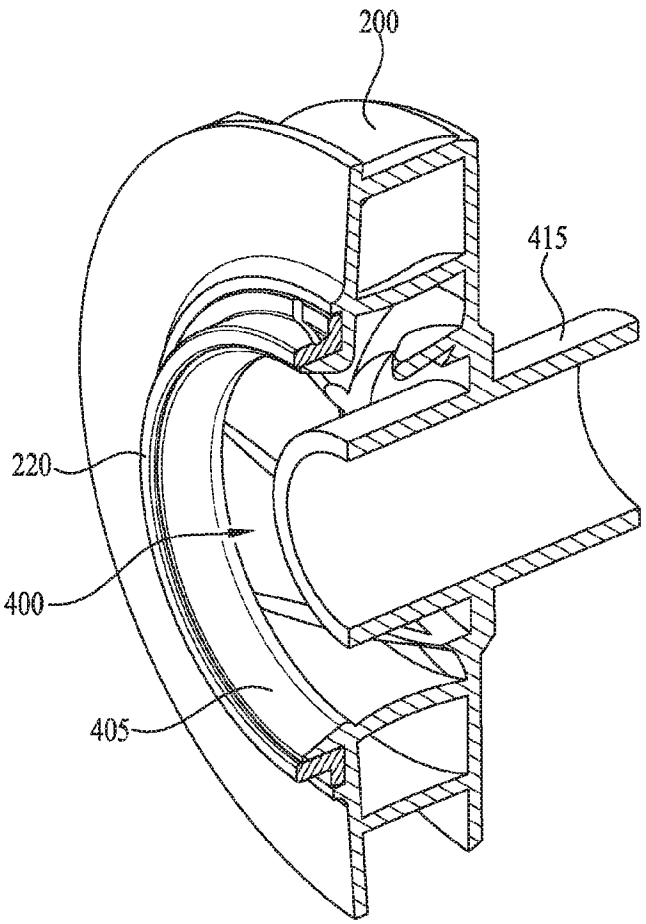
FIG. 3 is a cross sectional view of a bottom of an impeller with an impeller support insert of an illustrative embodiment.
Figure 11:
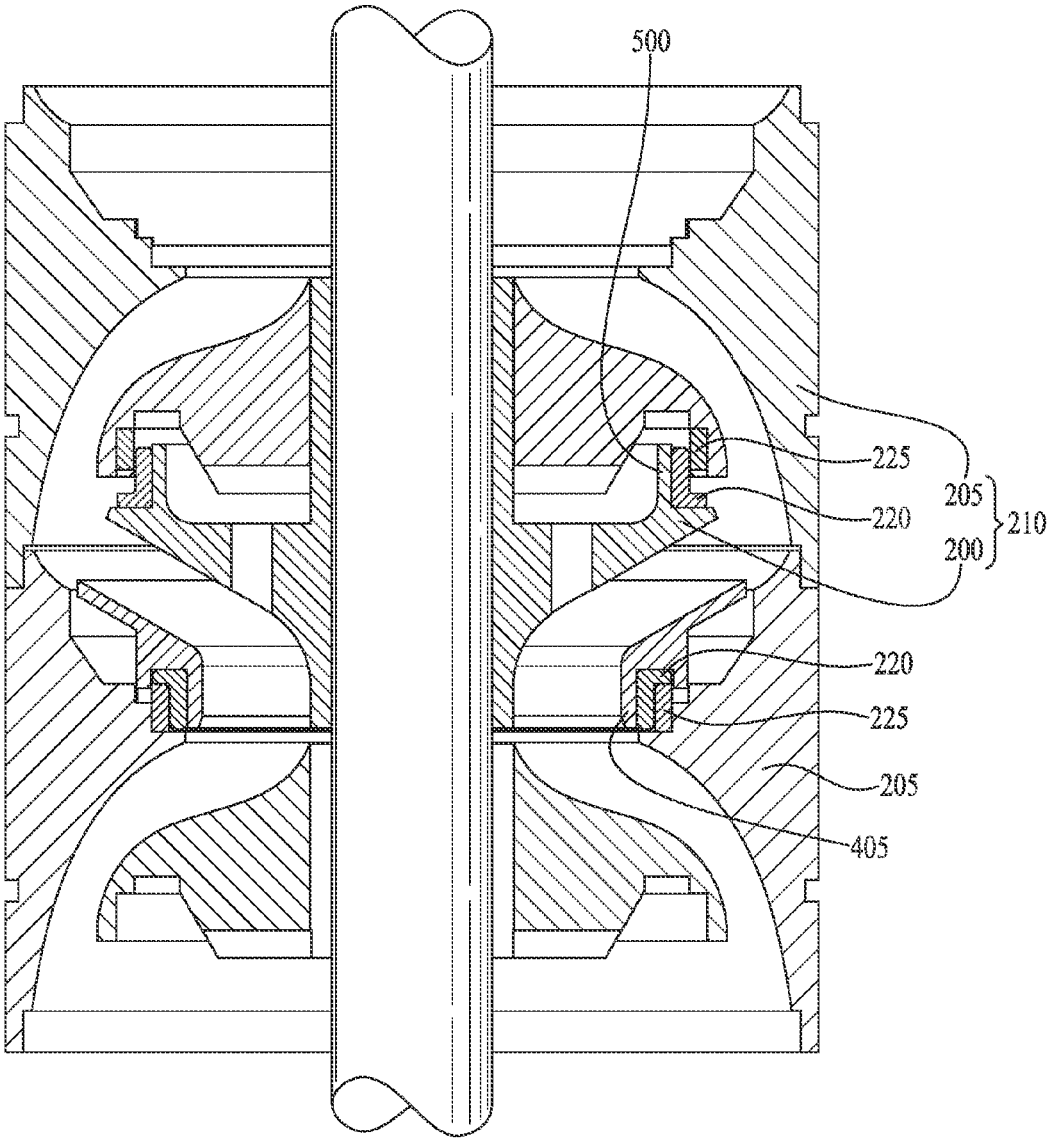
FIG. 11 is a cross sectional view of a centrifugal pump including an impeller support insert of illustrative embodiments having a flange and sleeve.
Figure 12:
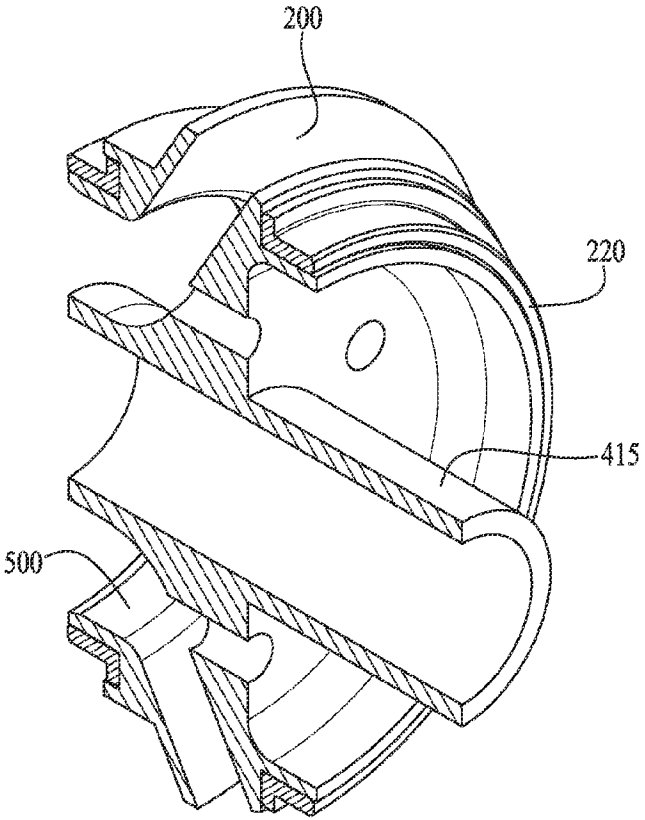
FIG. 12 is a cross sectional view of a top of an impeller with an impeller support insert of an illustrative embodiment.

FIG. 3 is an illustrative embodiment of a bottom of an impeller. As shown in FIG. 3, impeller 200 includes eye 400. Eye 400 may be an opening on a downthrust side of impeller 200 and may serve as the flow inlet of impeller 200. Impeller eye skirt 405 may extend axially in an upstream direction from the portion of impeller 200 forming an edge of eye 400 and/or the wall of eye 400. Inner diameter of impeller eye skirt 405 may face impeller hub 415. The pump's shaft 215 extends axially through impeller hub 415 when impeller 200 is stacked in pump stage 210 (shown in FIG. 11). Impeller hub 415 may be keyed to the pump shaft 215, such that impeller 200 rotates with shaft 215. As shown in FIG. 11 and FIG. 12, the top of impeller 200 may include balance ring skirt 500, which may extend axially on the top side of impeller 200.

Impeller support insert 220 may be an attachment secured around the outer diameter of impeller eye skirt 405, as illustrated in FIG. 3, or secured around the outer diameter of balance ring skirt 500 as illustrated in FIG. 12. Impeller support insert 220 may be press fit, bolted, pinned, keyed and/or otherwise mechanically locked using bonding mechanisms such as gluing, epoxying, soldering, dowel pins, a key, bonding agent and/or threading onto impeller eye skirt 405 and/or balance ring skirt 500. Impeller 200 and impeller support insert 220 may rotate together during operation of the centrifugal pump and/or in floater style stages may "float" axially along shaft 215 (shown in FIG. 5) during pump operation. In floater-type stages, impeller 200 may be allowed to move axially on shaft 215 between diffusers 205. As those of skill in the art understand, a floater-type impeller 200 does not truly float. Instead, impeller 200 may run in a downthrust position, and at high flow rates, may move into upthrust. Because impeller support insert 220 of illustrative embodiments may be attached to impeller eye skirt 405 and/or balance ring skirt 500, and not shaft 215, additional fastening options other than key, as described herein, are available which may assist in alleviating fretting at the keyway.

Figure 9:
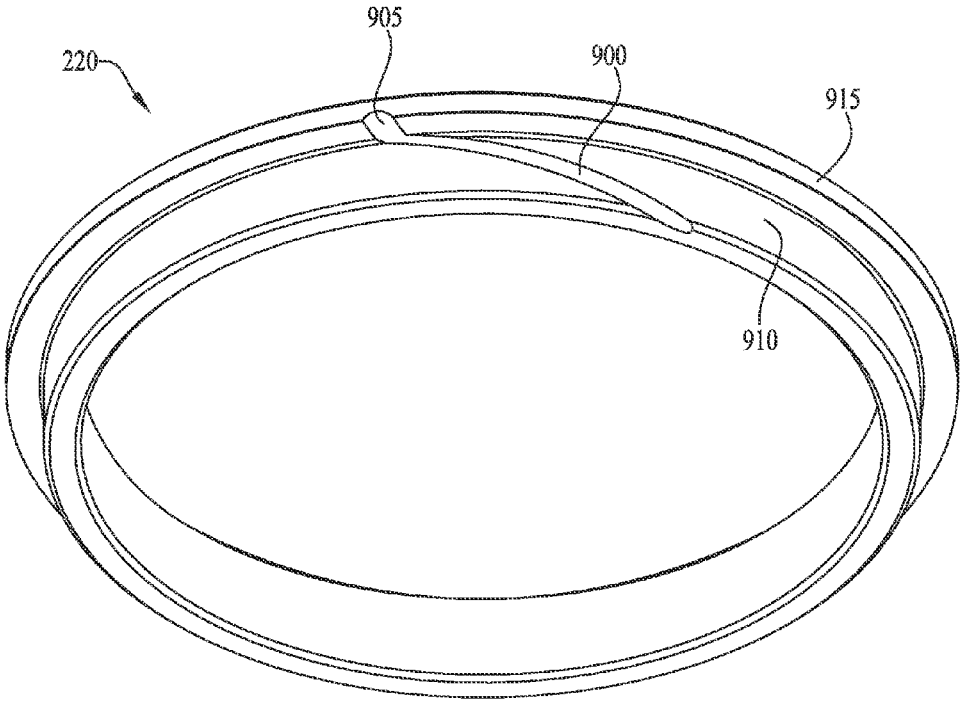
FIG. 9 is a perspective view of an impeller support insert of an illustrative embodiment.

FIG. 9 is an illustrative embodiment of an impeller support insert. Impeller support insert 220 may comprise a hard, abrasion resistant material such as tungsten carbide, silicon carbide or titanium carbide. Impeller support insert 220 may generally be sized so as to fit snugly around the outer diameter of impeller eye skirt 405 or balance ring skirt 500. Impeller support insert 220 may include sleeve 910 and flange 915. Sleeve 910 may extend tubularly around outer diameter of impeller eye skirt 405 or balance ring skirt 500. Flange 915 may extend radially from sleeve 910 (perpendicularly to a longitudinal axis of the centrifugal pump shaft). In the case of a downthrust impeller support insert 220, flange 915 may extend on a downstream side of flange 915. In the case of an upthrust impeller support insert, flange 915 may extend radially on an upstream side of sleeve 910. In either case, impeller support insert 220 may hug the radial surface of impeller 200 adjacent to sleeve 910.

Figure 14:
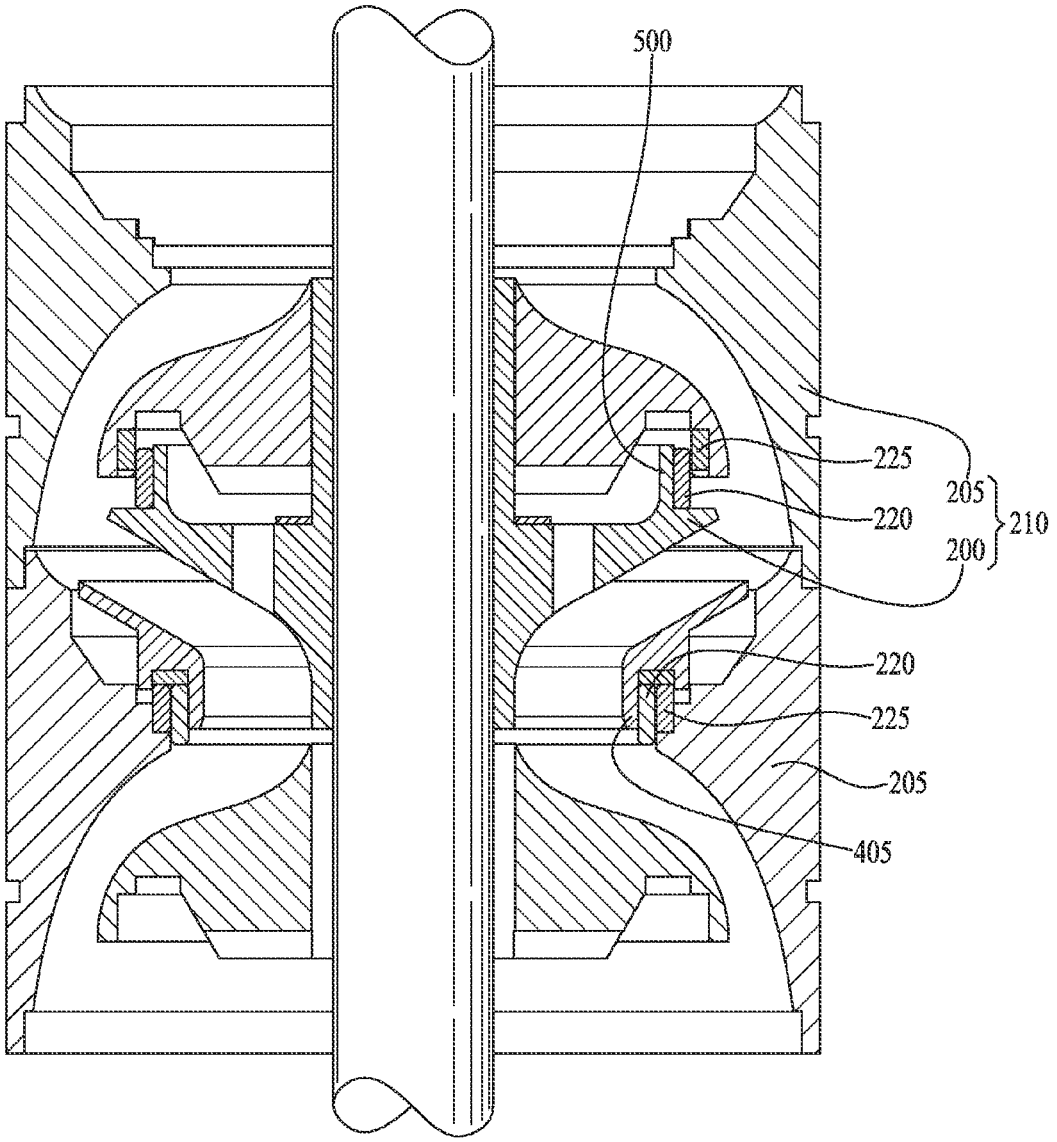
FIG. 14 is a cross sectional view of a centrifugal pump including an impeller support insert of illustrative embodiments having an unflanged sleeve.

As illustrated in FIG. 14, in some embodiments, flange 915 may be omitted and impeller support insert 220 may include only sleeve 910. In one example, only sleeve 910, and not flange 915, may be included on impeller support insert 220 in compression and/or floater style embodiments for radial stabilization. The embodiment illustrated in FIG. 14 may provide radial stabilization and abrasive resistance at the eye to balance seal.

The outer surface(s) of impeller support insert 220 (facing away from impeller skirt 405, 500) may include grooves that may assist and/or guide the flow of working fluid, and abrasive solids that may be contained therein, across the surface of impeller support insert 220. As shown in FIG. 9, insert axial groove 900 may extend diagonally across sleeve 910. In some embodiments, insert axial groove 900 may extend vertically across outer surface of sleeve 910 facing bushing 225. Insert radial groove 905 may extend across the downstream and/or upstream surface of flange 915. In certain embodiments, insert axial groove 900 may intersect with insert radial groove 905 at the interface of flange 910 and sleeve 915. Insert axial groove 900 and/or insert radial groove 905 may provide a pathway for the flow of fluid and solids around and/or passed the surface of impeller support insert 220 and may reduce heat, friction and/or abrasion. In some embodiments, grooves on the surface of impeller support insert 220 are not necessary and/or impeller support insert 220 may not include insert radial groove 905 and/or insert axial groove 900.

Figure 13:
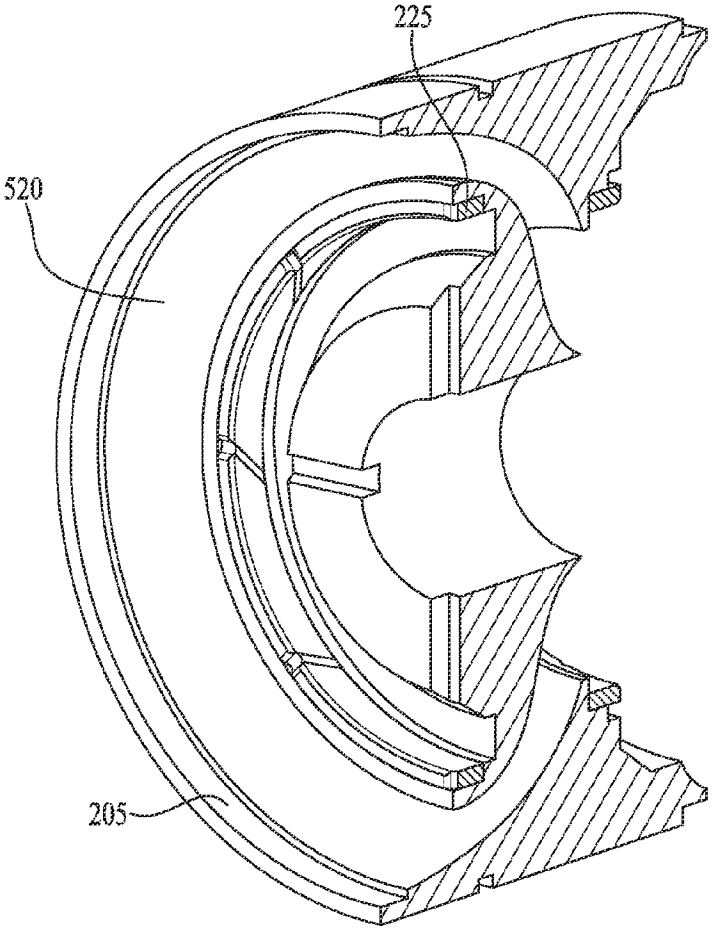
FIG. 13 is a cross sectional view of an upthrust side of a diffuser with a bushing of an illustrative embodiment.

FIG. 4 illustrates a downthrust side of a diffuser of illustrative embodiments. Downthrust side of diffuser 205 includes flow exit 230, which flow exit 230 may be an opening where working fluid exits diffuser 205. Flow exit 230 may extend outward of impeller eye skirt 405 when diffuser 205 is stacked with impeller 200. FIG. 13 illustrates an upthrust side of diffuser 205. Upthrust side of diffuser 205 includes flow entrance 520, which flow entrance 520 may be an opening where working fluid enters diffuser 205. Flow entrance 520 may extend outward of balance ring skirt 500 when diffuser 205 is mated with impeller 200 to form stage 210.

Flow exit 230 may include bushing 225, which bushing 225 may be pressed into the inner diameter of the wall surrounding flow exit 230. Diffuser 205 portions defining flow exit 230 may be machined prior to insertion of bushing 225 in order to remove material from the wall of diffuser flow exit 230 to create space for bushing 225. Bushing 225 may surround and/or be located outwards of impeller support insert 220 when impeller 200 is mated with and/or stacked on diffuser 205, with a tolerance between the two components. Similarly, flow entrance 520 may include bushing 225, which bushing 225 may be pressed into the inner diameter of the wall surrounding flow entrance 520. Diffuser 205 portions defining flow entrance 520 may be machined prior to insertion of bushing 225 in order to remove material from the wall of diffuser flow exit 230 to create space for bushing 225. Bushing 225 may surround and/or be located outwards of impeller support insert 220 when impeller 200 is mated with diffuser 205, with a tolerance between the two components.

As illustrated in FIG. 11, in the case of impeller support insert 220 on the top of impeller 220, bushing 225 serving as an upthrust bushing and paired with impeller support insert 220 is secured to a diffuser 205 of the same stage 210 as impeller 200. Also as illustrated in FIG. 11, in the case of impeller support insert 220 on the bottom of impeller 220, bushing 225 serving as a downthrust bushing and paired with support insert 220 is secured to a diffuser 205 of the previous stage as impeller 200. The embodiment shown in FIG. 11 may provide radial stabilization as well as up to down thrust protection combined with eye to balance abrasive resistance.

Figure 8:
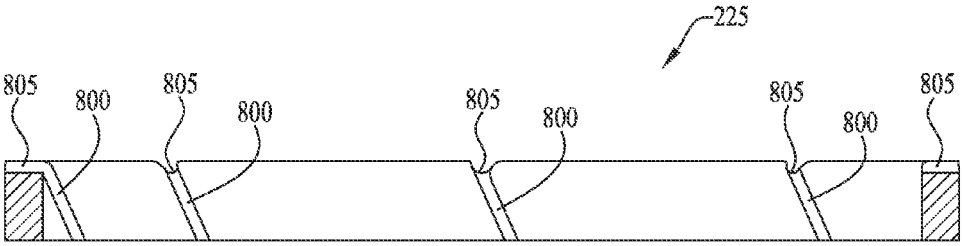
FIG. 8 is a cross sectional view of a bushing of an illustrative embodiment.

FIG. 8 illustrates an exemplary embodiment of bushing 225. Bushing 225 may be disc and/or cylindrical in shape with a central opening, and may made of a hard, abrasion resistant material such as tungsten carbide, silicon carbide or titanium carbide. The outer surfaces of bushing 225 may include grooves that may assist and/or guide the flow of working fluid, and abrasive solids that may be contained therein, across the surfaces of bushing 225. As shown in FIG. 8, the axial surface on the inner diameter of bushing 225 may include bushing axial grooves 800, which may be vertical or traverse the surface diagonally. Downstream and/or upstream radial surface of bushing 225 may include bushing radial grooves 805. Bushing axial grooves 800 and bushing radial grooves 805 may intersect at the meeting of the axial and radial surfaces of bushing 225. Bushing axial groove 800 and/or bushing radial groove 805 may provide a pathway for the flow of fluid and solids around and/or passed the surface of bushing 225 and may reduce heat, friction and/or abrasion. In some embodiments, grooves on bushing 225 may not be necessary and/or bushing 225 may not include bushing axial grooves 800 and/or bushing radial grooves 805.

Figure 5:
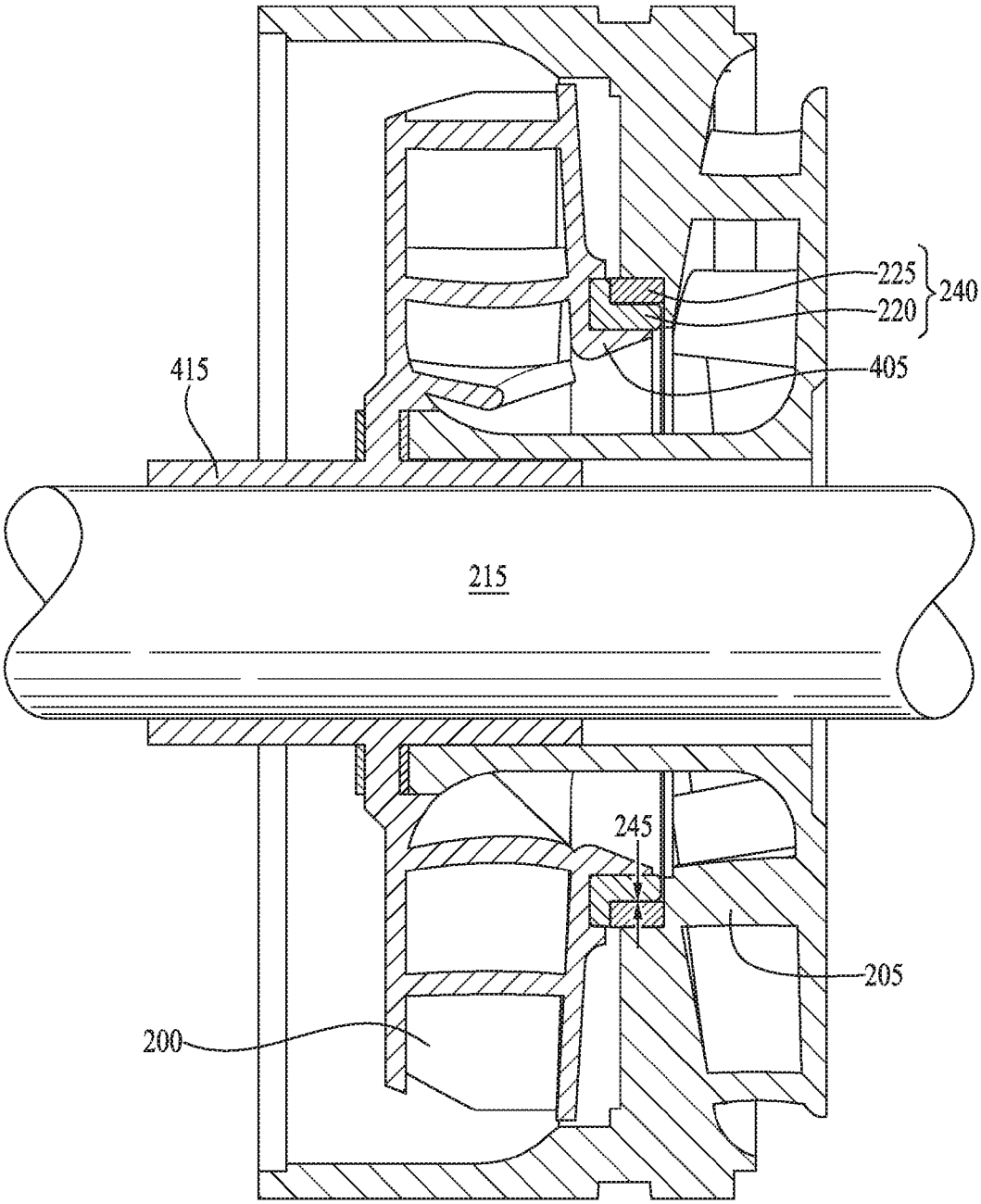
FIG. 5 is a cross sectional view of a centrifugal pump of an illustrative embodiment.
Figure 6:
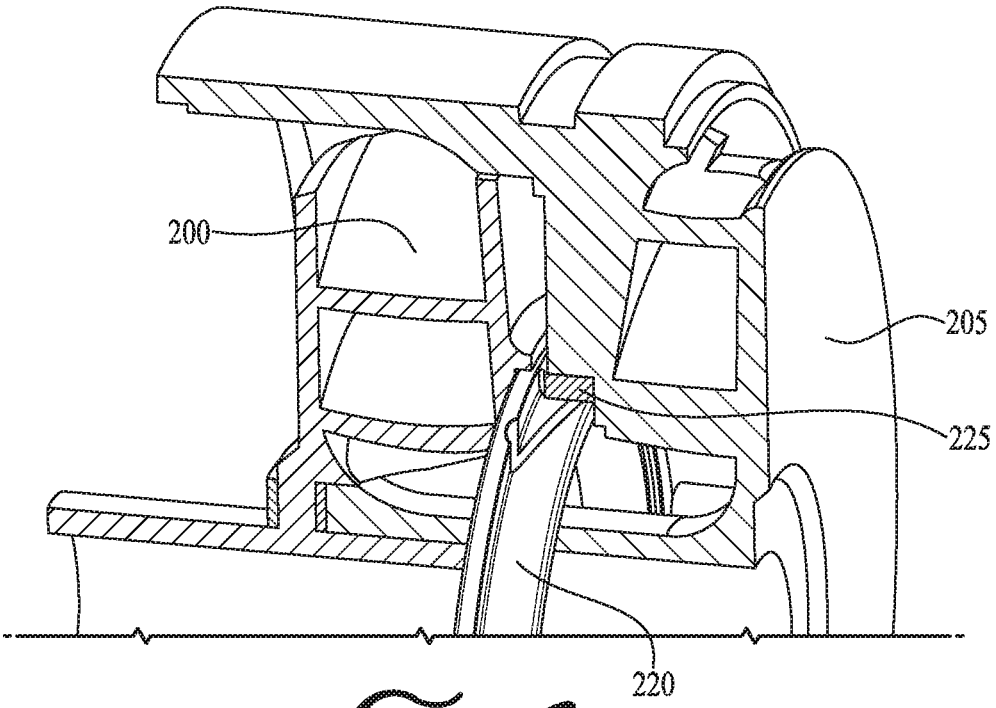
FIG. 6 is a partial cross sectional view of an impeller support insert of an illustrative embodiment.

FIGS. 5 and 6 illustrate a stacked impeller and diffuser of an illustrative embodiment. Impeller 200 may be inward of diffuser 205. Hub 415 of impeller 200 may be keyed to shaft 215, such that impeller 200 rotates with shaft 215. Multiple stages 210 of impeller 200 and diffuser 205 pairs may be stacked in series as part of a multistage centrifugal pump, which may, for example, be part of an ESP assembly. In some embodiments, stages 210 (shown in FIG. 11) of illustrative embodiments may be combined with conventional pump stages. For example, stages 210 may alternate with conventional pump stages, or for every stage 210 there may be three or four conventional stages. In certain embodiments, all pump stages are stages 210. In some embodiments bearing set may be included in one of a top, bottom or both of impeller 200 and corresponding diffuser 205.

Impeller support insert 220 may be keyed, pinned, bolted and/or pressed into impeller 200, around the outer diameter of impeller eye skirt 405 and/or balance ring skirt 500. During operation of the centrifugal pump, impeller support insert 220 may rotate with impeller 200, just inside bushing 225, which bushing 225 may be fixed into wall of flow exit 230 and/or flow entrance 520 of diffuser 205. Bushing 225 may not rotate during operation and instead remain stationary with diffuser 205. Together, impeller support insert 200 and bushing 225 may form bearing set 240, which may carry the loads conventionally carried by impeller eye skirt 405, the diffuser downthrust pad and/or a conventional downthrust washer, and/or balance ring skirt 500, the diffuser upthrust pad and/or a conventional upthrust washer. Bushing 225 may be paired with impeller support insert 220 to provide hydraulic lift. Bushing 225 of bearing set 240 may hold a "sealing" tolerance as an improvement over conventional abrasion resistant bearings that are not typically used for lift.

Bushing 225 may be pressed into the inner diameter wall of flow exit 230 and/or flow entrance 520 of diffuser 205, facing impeller support insert 220. Bushing 225 may extend circumferentially around impeller support insert 220, with impeller support insert 220 rotating within bushing 225 during operation of the centrifugal pump, and a clearance gap 245 between the faces. A hydraulic and/or hydrodynamic clearance gap 245 of between 0.012 and 0.016 inches diametrically may be located between the faces of stationary bushing 225 and impeller support insert 220, through which pumped fluid may flow. Pumped fluid flowing between the faces of stationary bushing 225 and rotating flanged sleeve 220 may form a hydrodynamic fluid film and/or pressure wedge, which may provide both axial and radial support to the pump.

Figure 7:
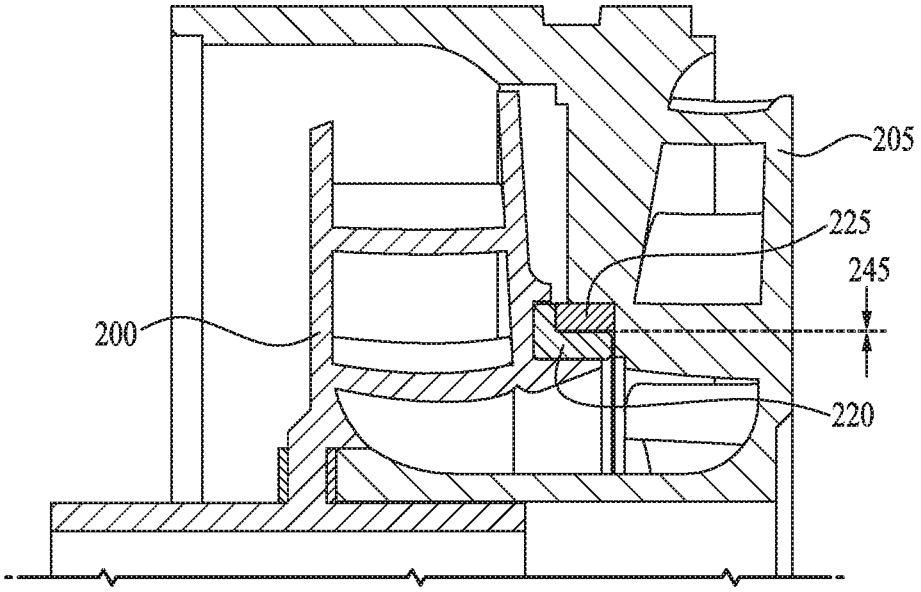
FIG. 7 is a cross-sectional view of a hydraulic bearing set of an illustrative embodiment.

FIG. 7 is a cross sectional view of a radial gap between impeller support insert 220 and stationary bushing 225. Referring to FIG. 7, clearance gap 245 may have a radial clearance of between about 0.006 and 0.008 inches. Impeller support insert 220 and bushing 225 may comprise tungsten carbide, be coated with tungsten carbide, be coated with a polymer composite diamond coating be polished and/or be coated with a dry or solid lubricant such as molybdenum disulfide or graphite. These materials may assist impeller support insert 220 and bushing 225 to resist abrasive wear and assist in maintaining clearance gap 245 at no larger than 0.016 diametrically, despite contact with abrasives in pumped fluid. Bearing set 240 may obviate the need for a flanged sleeve keyed to shaft 215, the need for a diffuser downthrust pad and/or downthrust washer, the need for a diffuser upthrust pad and/or upthrust washer, and the need for tungsten carbide coating on impeller skirt 405, although these additional components may be included in combination with bearing set 240 if additional support is desired.

As shown in FIGS. 8 and 9, the surfaces of bushing 225 and/or impeller support insert 220 may include grooves, which grooves may enhance the abrasion resistance of bushing 225 and/or impeller support insert 220 by creating channels in the radial and/or axial support surfaces. The channels may break up the bearing surfaces and create paths for solids and fluids to traverse. The grooves may reduce body wear in the bearing surfaces by decreasing solids production and reducing the heat in the bearings that would otherwise degrade the bearing surfaces. In some embodiments, the grooves may extend circumferentially about the radial and/or axial surfaces of bushing 225 and/or impeller support insert 220. In certain embodiments, the grooves may be axial, radial and/or thrust surface grooves that spiral and/or are angled based upon the surface and direction of the groove. For example, a bushing axial groove 800 on stationary bushing 225 may extend across the axial surface of stationary bushing 225 at a 60°, 80° or 90° (vertical) angles, which bushing axial groove 800 may intersect with a bushing radial groove 805 or circumferential groove on the radial surface of stationary bushing 225. In certain embodiments, no intersection of the grooves may be necessary.

Figure 10:
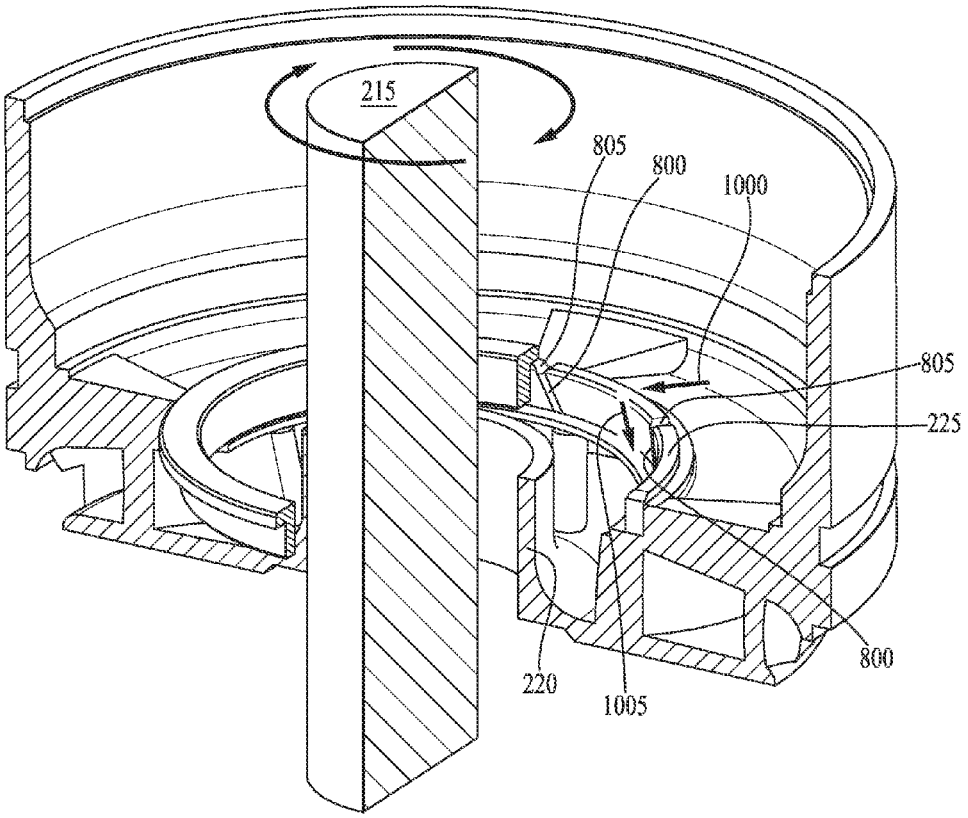
FIG. 10 is a cross sectional view of a centrifugal pump of an illustrative embodiment.

FIG. 10 illustrates an example of the fluid flow across the surfaces of bearing set 240 of illustrative embodiments. As shown in FIG. 10, bushing 225 includes bushing axial groove 800, which extends diagonally across bushing 225 axial surface, and bushing radial groove 805, which intersects with bushing axial groove 800. Abrasives in the working fluid may flow back down the pump stages. As they do so, diagonal bushing axial groove 800 and bushing radial groove 805 may create a path for the abrasive solids to traverse, and may thereby reduce body wear and/or heat in the bearings. As illustrated in FIG. 10, abrasives may flow radially across bushing 225 guided by bushing radial groove 805, as demonstrated by radial arrow 1000, and then flow axially downward across axial surface of bushing 225, guided by bushing axial groove 800, as demonstrated by axial arrow 1005. Fluid and abrasives may flow through clearance gap 245 (shown in FIG. 7) between bushing 225 and impeller support insert 220. As working fluid moves to successive stages, the fluid may also flow through radial groove 805 and axial groove 800 in a direction opposite to axial arrow 1005 and radial arrow 1000 but still following the pathway created by the grooves.

A centrifugal pump impeller support system and apparatus has been described. Illustrative embodiments provide for an impeller support insert and bushing that may create a hydraulic seal between an impeller and a diffuser of a centrifugal pump. Illustrative embodiments may provide hydraulic lift, may be resistant to abrasive wear, and/or may provide radial and/or axial support to the impeller. Illustrative embodiments may improve prior art stages in that a single bearing set serves the function of what was previously two separate pump components: a thrust bearing set having a flanged sleeve keyed to the shaft and tungsten carbide coating on the impeller skirt, diffuser flow exit and/or diffuser flow entrance. In addition, in illustrative embodiments a washer adjacent to the impeller skirt may no longer be necessary, the diffuser downthrust pad may no longer carry downthrust loads, the diffuser upthrust pad may no longer carry upthrust loads, and/or the impeller and diffuser hubs, which are susceptible to abrasive wear, may no longer be the primary source of radial support to the pump.

While the invention herein disclosed has been described by means of specific embodiments and applications thereof, numerous modifications and variations could be made thereto by those skilled in the art without departing from the scope of the invention set forth in the claims. The foregoing description is therefore considered in all respects to be illustrative and not restrictive. The scope of the invention is indicated by the appended claims, and all changes that come within the meaning and range of equivalents thereof are intended to be embraced therein.

What is claimed is:

1. A centrifugal pump comprising:

an impeller secured to a centrifugal pump shaft, the impeller comprising:

at least one of an impeller eye skirt, a balance ring skirt or both; and an impeller support insert secured around an outer diameter of at least one of the at least one skirts, each of the at least one impeller support inserts comprising:

a sleeve extending tubularly around the skirt; and a flange extending perpendicularly to a longitudinal axis of the centrifugal pump shaft.

2. The centrifugal pump of claim 1, wherein the at least one skirt is the impeller eye skirt extending axially from a portion defining an eye of the impeller.

3. The centrifugal pump of claim 2, further comprising:

a diffuser stacked adjacent to the impeller, the diffuser comprising:

a portion defining a diffuser flow exit, wherein the impeller eye skirt extends within the portion defining the diffuser flow exit; and a bushing secured around an inner diameter of the portion defining the diffuser flow exit outward of the impeller support insert.

4. The centrifugal pump of claim 1, wherein the at least one impeller skirt is a balance ring skirt.

5. The centrifugal pump of claim 4, further comprising:

a diffuser paired with the impeller, the diffuser comprising:

a portion defining a diffuser flow entrance, wherein the balance ring skirt extends within the portion defining the diffuser flow entrance; and a bushing secured around an inner diameter of the portion defining the diffuser flow entrance outward of the impeller support insert.

6. The centrifugal pump of claim 5, wherein the bushing comprises an abrasion resistance groove.

7. The centrifugal pump of claim 5, wherein the bushing and impeller support insert comprise tungsten carbide.

8. The centrifugal pump of claim 1, wherein the impeller is in an electric submersible pump assembly.

9. The centrifugal pump of claim 1, wherein each of the impeller support inserts is one of press fit, bolted or pinned around the outer diameter of the at least one skirt.

10. A centrifugal pump comprising:

a diffuser fixedly secured within a housing of a centrifugal pump, the diffuser comprising a portion defining a flow exit;

an impeller keyed to a shaft of the centrifugal pump, the impeller comprising a skirt extending inward of the portion defining the flow exit and axially from a portion of the impeller defining an eye;

a sleeve affixedly coupled around an outer diameter of the skirt; and a bushing secured circumferentially about an inner diameter of the portion defining the flow exit outward of the sleeve, wherein the sleeve further comprises a flange extending radially from the sleeve on a downstream side of the sleeve.

11. The centrifugal pump of claim 10, wherein the impeller and the diffuser are in a multi-stage centrifugal pump.

12. The centrifugal pump of claim 11, wherein the multi-stage centrifugal pump is in an electric submersible pump (ESP) assembly.

13. The centrifugal pump of claim 10, wherein a surface of the bushing facing the sleeve comprises a diagonal axial groove that intersects with a radial groove.

14. The centrifugal pump of claim 10, wherein a surface of the sleeve facing the bushing comprises a thrust surface groove and a radial groove that intersect.

15. A centrifugal pump comprising:

a plurality of centrifugal pump stages, wherein each of the plurality of centrifugal pump stages comprise:

a rotatable impeller inward of a stationary diffuser;

an impeller support insert fixedly attached to a top of the impeller such that the impeller support insert rotates with the impeller, wherein the impeller support insert is fixedly coupled to a balance ring skirt, and a bushing pressed into a portion defining a diffuser flow entrance and extending circumferentially about the impeller support insert such that the bushing and impeller support insert form a hydraulic bearing set; and wherein the impeller support insert is keyed to the balance ring skirt, the impeller is keyed to a pump shaft and the impeller support insert moves with respect to the pump shaft during operation of the plurality of centrifugal pump stages.

16. The centrifugal pump of claim 15, wherein the impeller support insert is fixedly attached to the balance ring skirt by one of pin, bolt, press fit or a combination thereof.

17. The centrifugal pump of claim 15, wherein the impeller support insert comprises a sleeve tubularly surrounding the balance ring skirt.

18. The centrifugal pump of claim 17, wherein the impeller support insert further comprises a flange extending radially from the sleeve.

19. The centrifugal pump of claim 18, wherein the flange extends radially on an upstream side of the flange.

* * * * *